US010670360B2

(12) United States Patent
Underwood et al.

(10) Patent No.: US 10,670,360 B2
(45) Date of Patent: Jun. 2, 2020

(54) HYBRID MOLDED FIREARM ASSEMBLIES

(71) Applicant: MEAN LLC., Woodstock, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 15/720,218

(22) Filed: Sep. 29, 2017

(65) Prior Publication Data

US 2018/0087859 A1 Mar. 29, 2018

Related U.S. Application Data

(60) Provisional application No. 62/401,479, filed on Sep. 29, 2016.

(51) Int. Cl.
*F41A 19/14* (2006.01)
*F41A 19/10* (2006.01)

(52) U.S. Cl.
CPC ..... *F41A 19/10* (2013.01); *F41A 19/14* (2013.01)

(58) Field of Classification Search
CPC ..... F41A 19/00; F41A 19/06; F41A 19/10; F41A 19/12; F41A 19/14; F41A 19/42–54
USPC ..... 42/69.01–69.03, 20, 42.03
See application file for complete search history.

(56) References Cited

U.S. PATENT DOCUMENTS 4,539,889 A * 9/1985 Glock ..... F41A 5/04 89/147
4,941,394 A * 7/1990 Zedrosser ..... F41A 19/02 89/129.02
5,913,261 A * 6/1999 Guhring ..... F41A 3/64 42/69.03
6,298,594 B1 * 10/2001 Strayer ..... F41A 19/10 42/69.01
6,640,479 B2 * 11/2003 Guhring ..... F41A 19/16 42/69.03
7,213,359 B2 * 5/2007 Beretta ..... F41A 19/44 42/69.03
9,052,149 B2 * 6/2015 Bender ..... F41A 19/10
9,863,730 B2 * 1/2018 Elftmann ..... F41A 19/15
2005/0011098 A1 * 1/2005 Fagundes de Campos ..... F41A 17/72 42/70.04
2006/0207149 A1 * 9/2006 Lazor ..... F41A 19/10 42/69.01
2015/0020426 A1 * 1/2015 Neergaard ..... F41A 19/10 42/69.01
2016/0054085 A1 * 2/2016 Miller, III ..... F41A 19/14 42/69.03
2016/0327357 A1 * 11/2016 Wheatley ..... F41A 19/10

* cited by examiner

*Primary Examiner* — Stephen Johnson
*Assistant Examiner* — Benjamin S Gomberg

(57) ABSTRACT

A hybrid molded assembly includes a trigger comprising a trigger skeleton and a trigger molded portion that at least partially encompasses the trigger skeleton, a hammer comprising a hammer skeleton and a hammer molded portion that at least partially encompasses the hammer skeleton, and a disconnector comprising a disconnector skeleton and a disconnector molded portion that at least partially encompasses the disconnector skeleton.

20 Claims, 12 Drawing Sheets

HYBRID MOLDED FIREARM ASSEMBLIES

CROSS REFERENCE TO RELATED APPLICATION

This application is related to and claims priority benefit from U.S. Provisional Application No. 62/401,479 ("the '479 application"), filed on Sep. 29, 2016, entitled HYBRID MOLDED FIREARM ASSEMBLIES. The '479 application is hereby incorporated in its entirety by this reference.

FIELD OF THE INVENTION

The field of the invention relates to firearms, particularly hybrid molded assemblies for firearms.

BACKGROUND

Firearms include numerous assemblies with complex shapes and interfaces between the various components. To ensure precise engagement between the various components, the assemblies may include multiple metallic components that are machined, forged, casted, a combination thereof, or any other process for preparing precise engagement among various components.

To simplify manufacturing including minimizing processes for manufacturing for metallic components, hybrid molded assemblies may be designed with simple metallic components (such as stamped metallic parts) that are co-molded with a second material (such as plastic or polymer). Using this construction, critical interfaces (such as the latch connection between the hammer and disconnector) may be constructed in an expedient cost-effective manner (such as being stamped as a simple metallic part) with second material (such as plastic or polymer) overmolded to form the remaining portions of the respective parts.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a hybrid molded assembly comprises: a trigger comprising a trigger skeleton and a trigger molded portion that at least partially encompasses the trigger skeleton; a hammer comprising a hammer skeleton and a hammer molded portion that at least partially encompasses the hammer skeleton; and a disconnector comprising a disconnector skeleton and a disconnector molded portion that at least partially encompasses the disconnector skeleton.

According to certain embodiments of the present invention, a hybrid molded assembly for a firearm comprises: a hybrid component comprising a skeleton and a molded portion, wherein: the skeleton comprises metal; the molded portion comprises at least one of plastic and polymer; the molded portion at least partially encompasses the skeleton; and the hybrid component comprises at least one of a hybrid trigger, a hybrid hammer, and a hybrid disconnector.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments focus on semi-automatic firearms and, in particular, AR-15 variant (civilian) or M16/M4 (military) firearms, the features, concepts, and functions described herein are also applicable (with potential necessary alterations for particular applications) to other assault rifles, rifles, carbines, shotguns, handguns, or any other type of firearm. Furthermore, although the illustrated embodiments focus on fire control group components (trigger, hammer, disconnector), the features, concepts, and functions described herein are also applicable (with potential necessary alterations for particular applications) to other firearm components including, for example, safeties, magazine releases, bolt releases, slide releases, sights, grips, stocks, magazines, magazine components, followers, or any other firearm component.

Figure 1A:
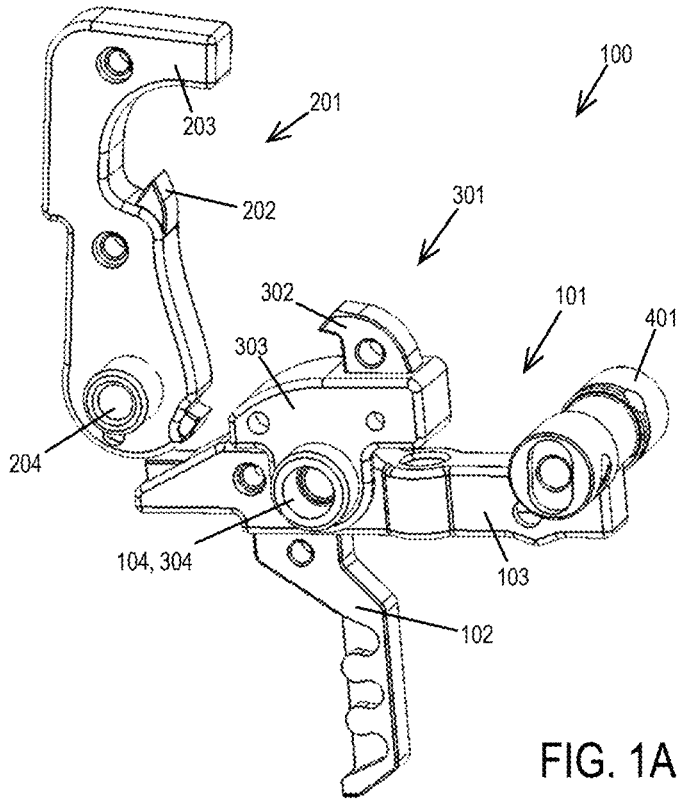
FIG. 1A is a rear perspective view of a hybrid molded assembly for a firearm, according to certain embodiments of the present invention.
Figure 1B:
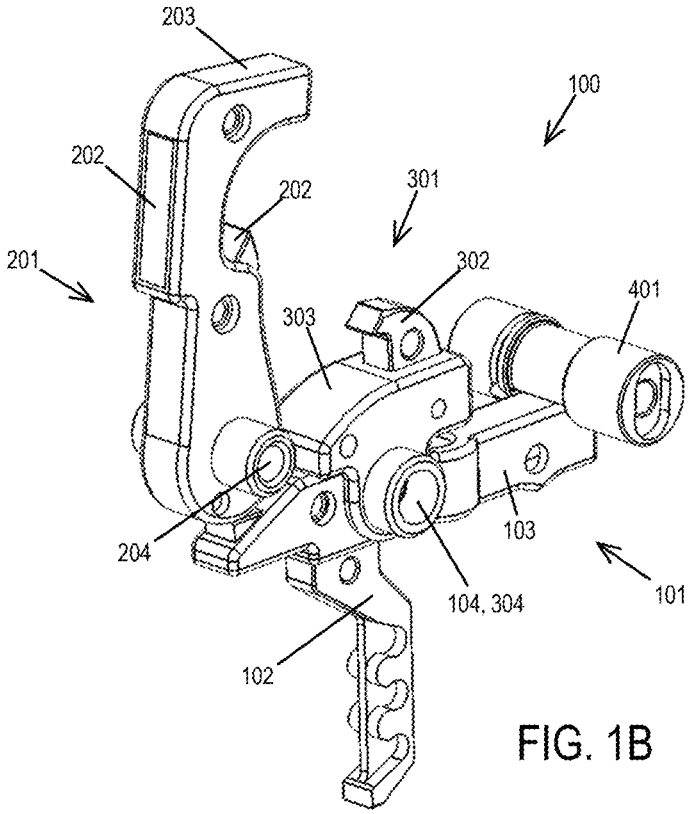
FIG. 1B is a rear perspective view of the hybrid molded assembly of FIG. 1A.
Figure 2:
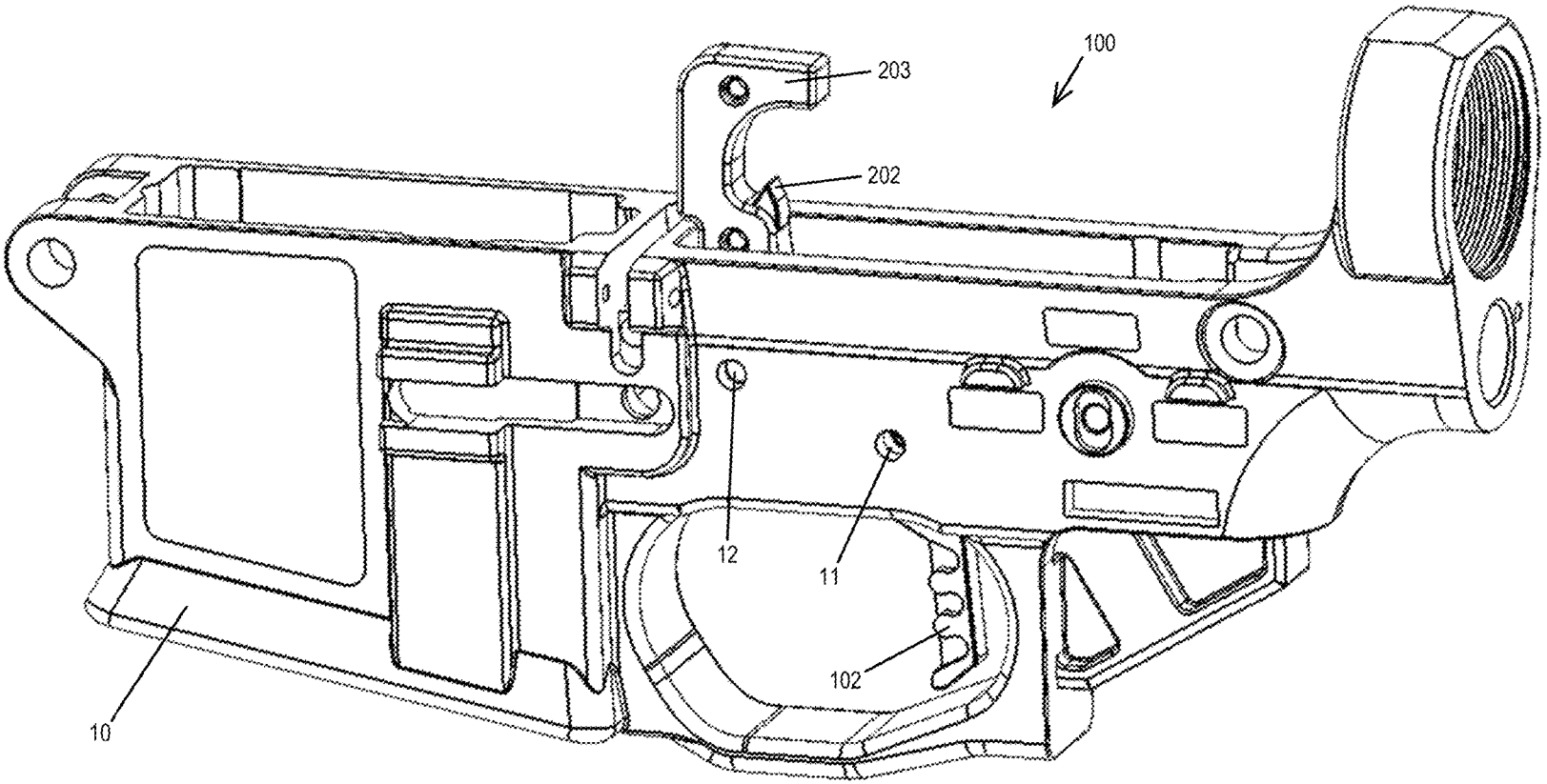
FIG. 2 is a perspective view of the hybrid molded assembly of FIG. 1A shown in context with a receiver.

According to certain embodiments of the present invention, as shown in FIGS. 1A, 1B, 8A, and 8B, a hybrid molded assembly 100 may include a hybrid trigger 101, a hybrid hammer 201, and/or a hybrid disconnector 301. As shown in FIG. 2, in some embodiments, the hybrid molded assembly 100 may be fixed with respect to receiver 10 of a firearm. In some embodiments, a pin (such as trigger pivot pin 51 shown in FIGS. 8A and 8B) may be inserted through trigger pin hole 11 of the receiver 10 such that the pin passes through pin hole 104 of the hybrid trigger 101 and through pin hole 304 of the hybrid disconnector 301. A second pin (such as hammer pivot pin 52 shown in FIGS. 8A, 8B, and 10D) may be inserted through hammer pin hole 12 of the receiver 10 such that the pin passes through pin hole 204 of the hybrid hammer 201.

As shown in FIGS. 1A, 1B, 3A-3C, 9A, and 9B, the hybrid trigger 101 may include a trigger skeleton 102 and a trigger molded portion 103 such that the trigger molded portion 103 at least partially encompasses the trigger skeleton 102. The hybrid hammer 201 (see FIGS. 1A, 1B, 6A, 6B, 8A, 8B, and 10A-10C) may include a hammer skeleton 202 and a hammer molded portion 203 such that the hammer molded portion 203 at least partially encompasses the hammer skeleton 202. As shown in FIGS. 1A, 1B, 7A, 7B, 11A, and 11B, the hybrid disconnector 301 may include a disconnector skeleton 302 and a disconnector molded portion 303 such that the disconnector molded portion 303 at least partially encompasses the disconnector skeleton 302.

Figure 3A:
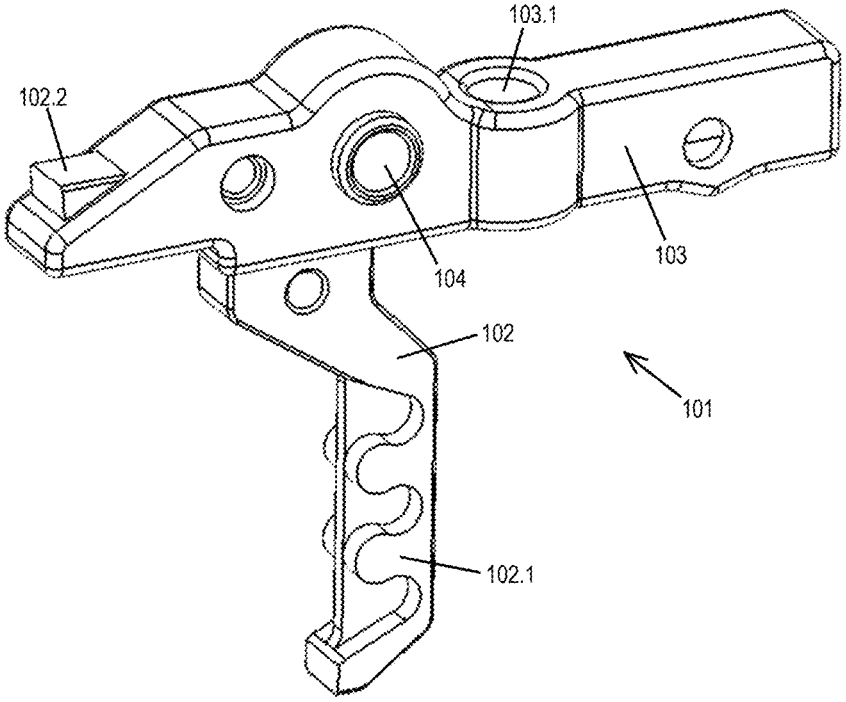
FIG. 3A is a perspective view of a trigger of the hybrid molded assembly of FIG. 1A.
Figure 9A:
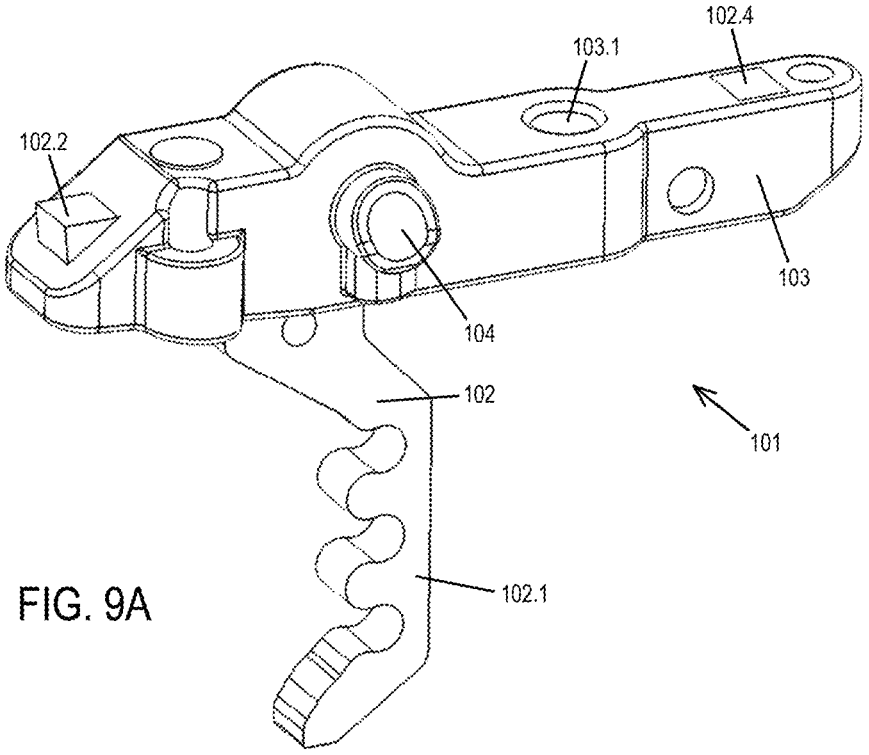
FIG. 9A is a perspective view of a trigger of the hybrid molded assembly of FIG. 8A.
Figure 9B:
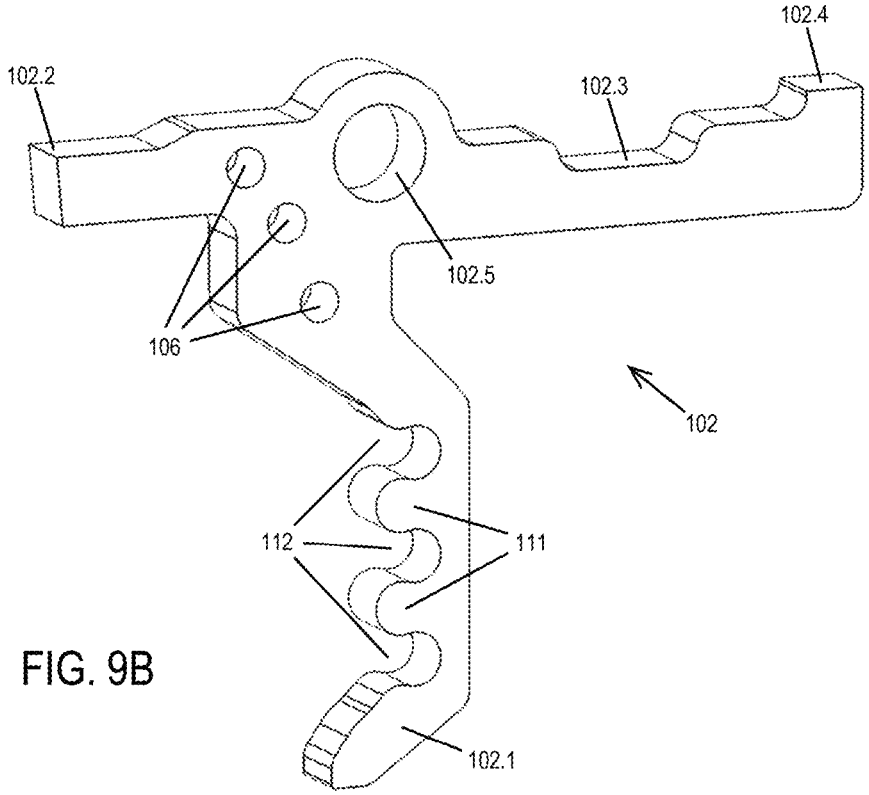
FIG. 9B is a perspective view of a trigger skeleton of the hybrid molded assembly of FIG. 8A.

The trigger skeleton 102 of the hybrid trigger 101 may include three arms extending in the bottom direction (bottom portion), forward direction (forward portion), and rear direction (rear portion). As shown in FIGS. 3A, 3B, 9A, and 9B, the bottom portion may include a finger interface portion 102.1, such that the operator can pivot the hybrid trigger 101 by pressing the finger interface portion 102.1. The forward portion may include a sear portion 102.2 configured to interface with the hybrid hammer 201 (in particular, sear protrusion 202.3). The rear portion may include a rear arm portion 102.3 that supports the disconnector spring cavity 103.1 and/or that interfaces with safety selector 401. The trigger skeleton 102 of the hybrid trigger 101 includes at least one trigger exposed portion that is at least partially exposed at the surface of the trigger molded portion 103 (and/or at least partially extends beyond the trigger molded portion 103). For example, as shown in FIGS. 3A, 9A, and 9B, the finger interface portion 102.1 and the sear portion 102.2 may be at least partially exposed at the surface of the trigger molded portion 103 (and/or at least partially extend beyond the trigger molded portion 103). In some embodiments, as shown in FIGS. 9A and 9B, the trigger skeleton 102 includes a selector portion 102.4 that is at least partially exposed at the surface of the trigger molded portion 103 (and/or at least partially extends beyond the trigger molded portion 103). The selector portion 102.4 may interface with the safety selector 401. In other words, the trigger skeleton 102 may have three trigger exposed portions (finger interface portion 102.1, sear portion 102.2, and/or selector portion 102.4).

Figure 3B:
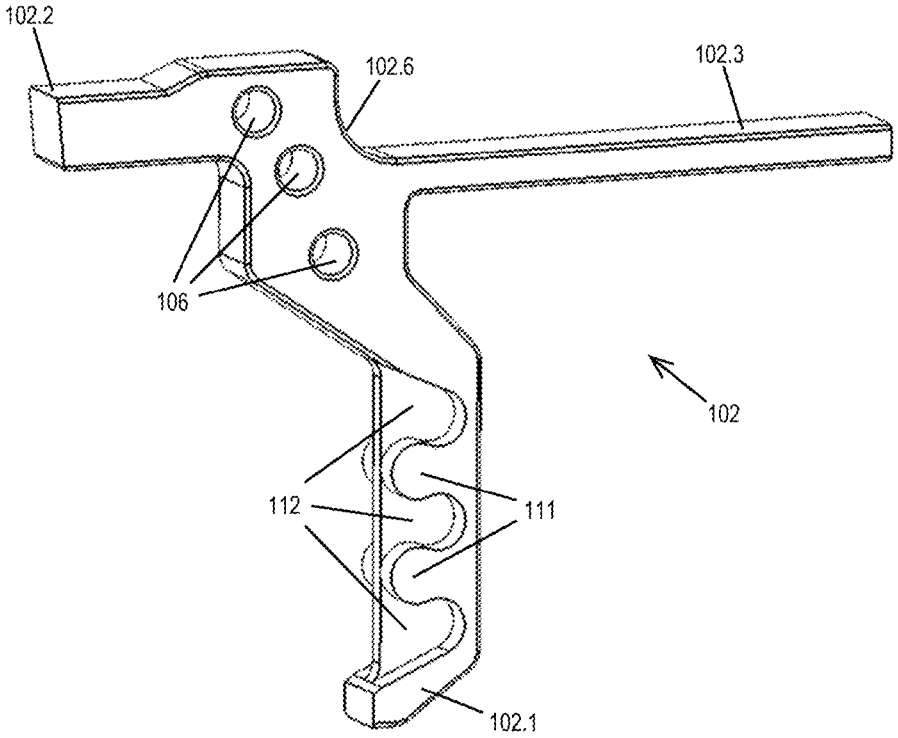
FIG. 3B is a perspective view of a trigger skeleton of the hybrid molded assembly of FIG. 1A.

The hybrid trigger 101 rotates about hole 104, which is formed in the trigger molded portion 103. In some embodiments, the hole 104 is located adjacent to curved surface 102.6 of the trigger skeleton 102 (see FIGS. 3A and 3B). Alternatively, in other embodiments, as shown in FIG. 9B, the trigger skeleton 102 includes a hole 102.5 to define and fix the location of the hole 104 relative to the trigger skeleton 102. As shown in FIGS. 3B and 9B, the trigger skeleton 102 may include at least one assembly hole 106. The at least one assembly hole 106 may be used to secure the trigger skeleton 102 during a molding process where the material for the molded portion 103 is added or injected (and subsequently cured). The spring cavity 103.1, in some embodiments, is a cylindrical recess in the molded portion 103 that extends to an upper surface of the rear arm portion 102.3 to accommodate a disconnector spring.

Figure 3C:
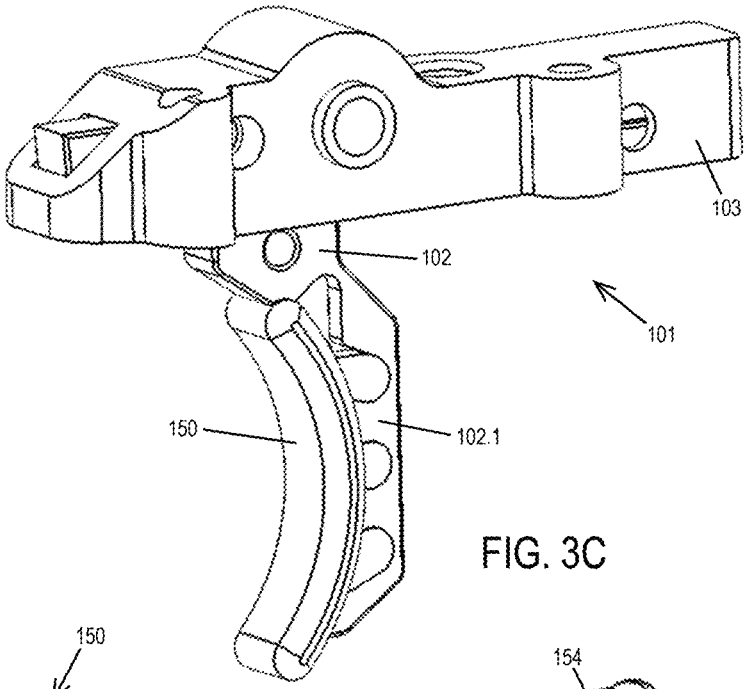
FIG. 3C is a perspective view of a trigger of the hybrid molded assembly of FIG. 1A.

As shown in FIGS. 3B and 9B, the finger interface portion 102.1, in some embodiments, includes features 111, 112 for mechanical attachment of modular replaceable trigger faces (e.g. 150, 160). For example, the finger interface portion 102.1 includes male features 111 and female features 112 that interface with a removable modular trigger face. The male and female features (111, 112) may include a keyhole shape or "lollipop" shape (as shown in FIGS. 3B and 9B), a dovetail shape, or any other appropriate shape. FIG. 3C shows one example of a modular trigger face (curved trigger face 150) mechanically attached to the finger interface portion 102.1.

Figure 4A:
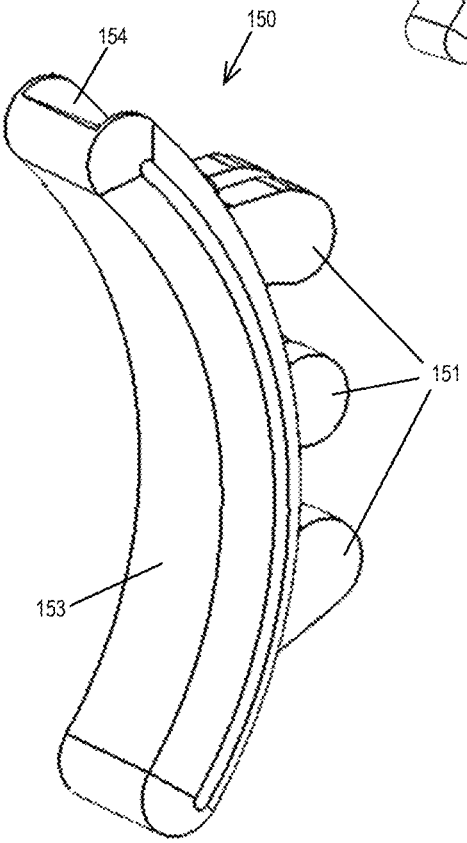
FIG. 4A is a front perspective view of a trigger insert of the hybrid molded assembly of FIG. 1A.
Figure 4B:
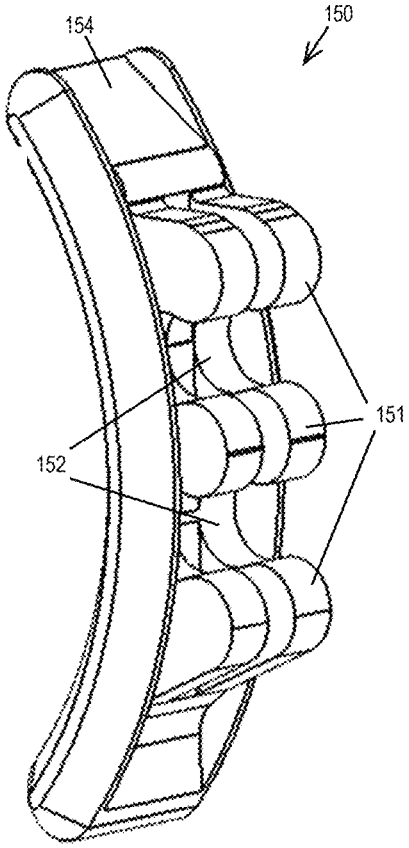
FIG. 4B is a rear perspective view of a trigger insert of the hybrid molded assembly of FIG. 1A.

FIGS. 3C, 4A, and 4B show a curved trigger face 150. The curved trigger face 150 includes a trigger surface 153 on a front side (that interfaces with an operator's finger) and male interface components 151 that interface/engage with female features 112 of the finger interface portion 102.1. The male features 111 of the finger interface portion 102.1 interface/engage with female features 152 of the curved trigger face 150 such that the male features 111 of the finger interface portion 102.1 are at least partially inserted into a channel 154 on a rear side of the curved trigger face 150.

Figure 5A:
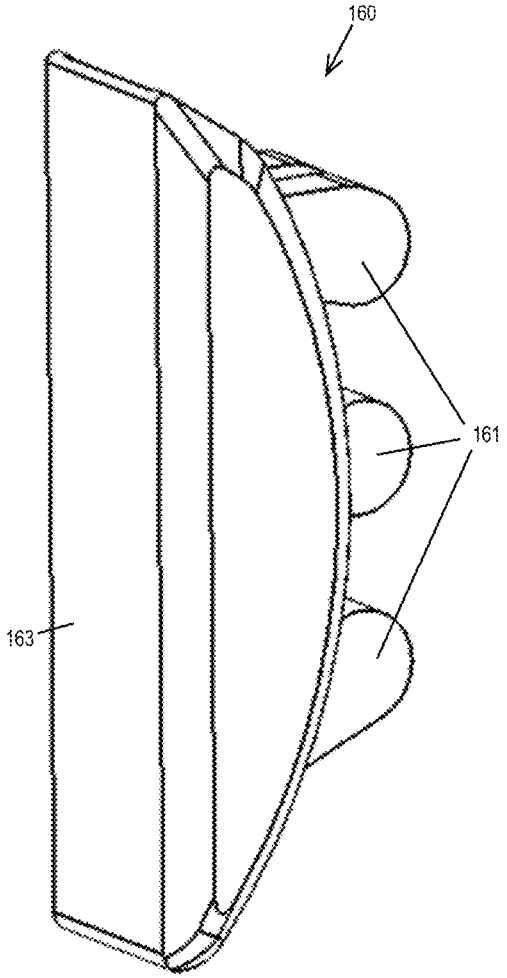
FIG. 5A is a front perspective view of a trigger insert of the hybrid molded assembly of FIG. 1A.
Figure 5B:
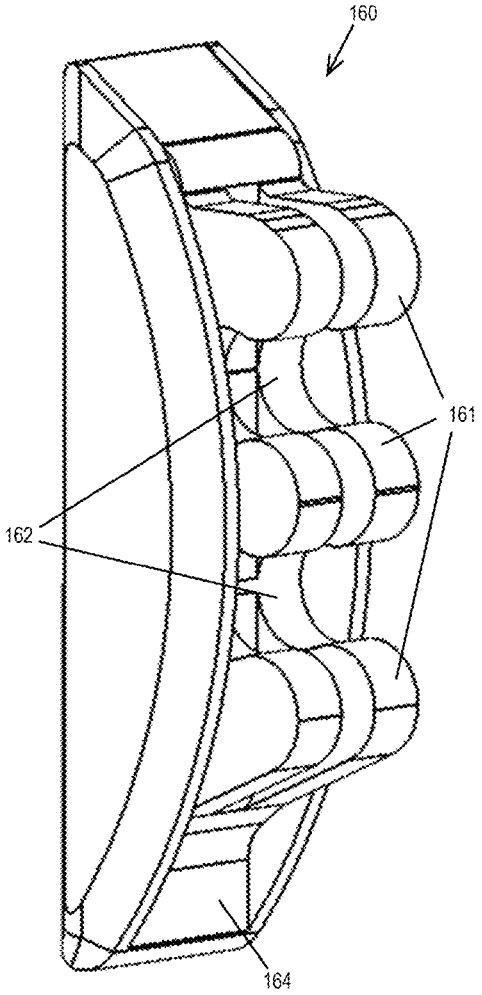
FIG. 5B is a rear perspective view of a trigger insert of the hybrid molded assembly of FIG. 1A.

FIGS. 5A and 5B show an alternative modular replaceable trigger face, straight trigger face 160. The straight trigger face 160 includes a trigger surface 163 on a front side (that interfaces with an operator's finger) and male interface components 161 that interface/engage with female features 112 of the finger interface portion 102.1. The trigger surface 163 may be at least partially flat or planer. The male features 111 of the finger interface portion 102.1 interface/engage with female features 162 of the straight trigger face 160 such that the male features 111 of the finger interface portion 102.1 are at least partially inserted into a channel 164 on a rear side of the straight trigger face 160. Although FIGS. 4A-5B show curved and straight trigger faces, any shape modular trigger face may be used. For example, the trigger face may include a protrusion extending from the bottom forward.

Figure 10A:
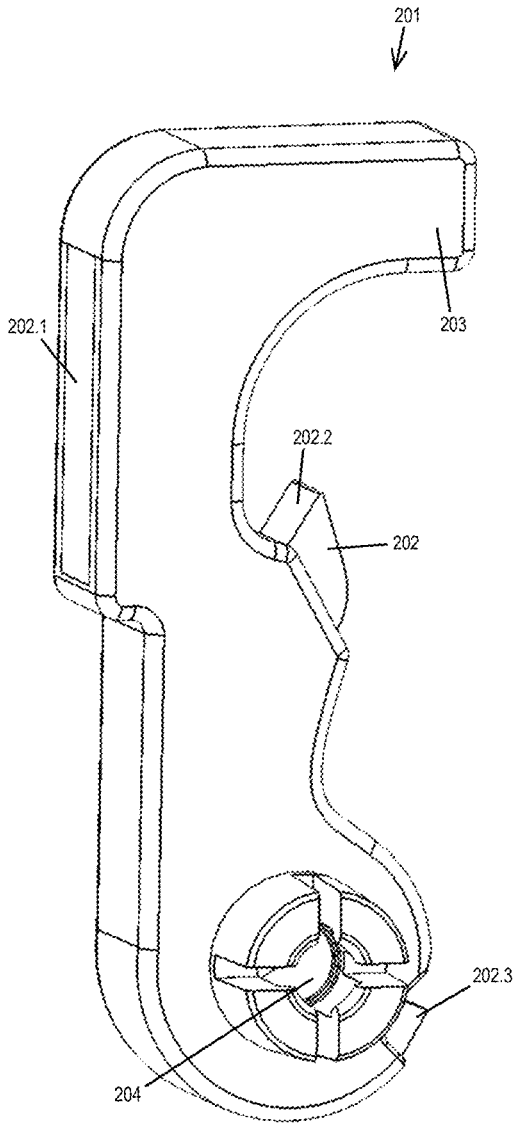
FIG. 10A is a perspective view of a hammer of the hybrid molded assembly of FIG. 8A.
Figure 10B:
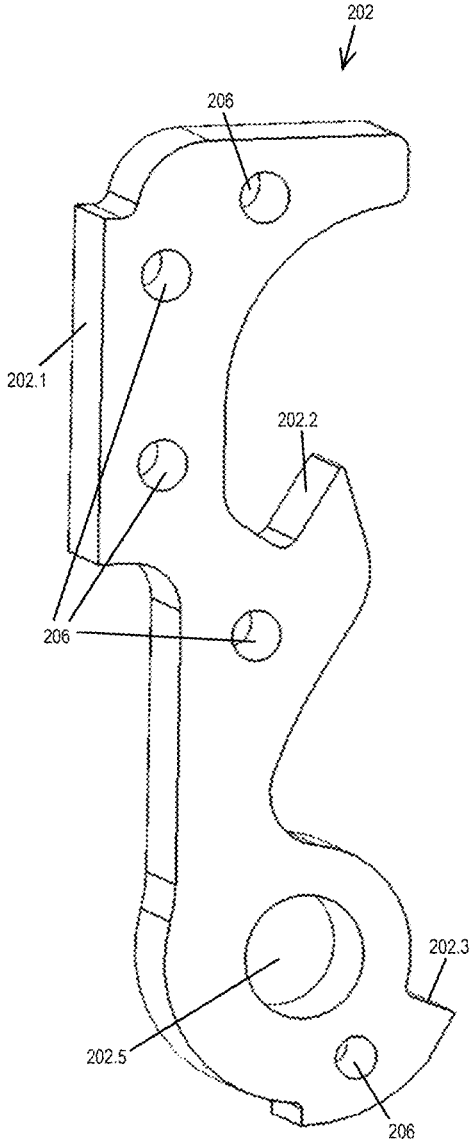
FIG. 10B is a perspective view of a hammer skeleton of the hybrid molded assembly of FIG. 8A.

As shown in FIGS. 6A, 6B, 10A, and 10B, the hammer skeleton 202 of the hybrid hammer 201 includes at least one hammer exposed portion that is at least partially exposed at the surface of the hammer molded portion 203 (and/or at least partially extends beyond the hammer molded portion 203). In some embodiments, the hammer exposed portion includes at least one of a firing pin interface surface 202.1, a disconnector interface tooth 202.2, and a sear protrusion 202.3. The firing pin interface surface 202.1 may include a surface that is at least partially flat or planer such that the surface is arranged at the exterior or outer surface of the hybrid hammer 201. In some embodiments, the firing pin interface surface 202.1 contacts a firing pin when the hybrid hammer 201 rotates about pin hole 204. The hole 204 may be located adjacent to curved surface 202.6 of the hammer skeleton 202 (see FIG. 6B). Alternatively, in other embodiments, as shown in FIG. 10B, the hammer skeleton 202 includes a hole 202.5 to define and fix the location of the hole 204 relative to the hammer skeleton 202. After a round is fired, the rearward movement of the bolt causes the hybrid hammer 201 to rotate about pin hole 204 such that the disconnector interface tooth 202.2 engages the hybrid disconnector 301 (in particular, disconnector hook 302.1). After the operator releases the trigger (finger interface portion 102.1) causing the hybrid trigger 101 to rotate about pin hole 104 (such that rear arm portion 102.3 moves down), the hybrid disconnector 301 rotates with the hybrid trigger 101 and releases the disconnector interface tooth 202.2. After the disconnector interface tooth 202.2 is released, the hybrid hammer 201 rotates about pin hole 204 until the sear protrusion 202.3 engages the sear portion 102.2 of the hybrid trigger 101. The firearm is then ready to fire a subsequent round such that the operator may press the finger interface portion 102.1 causing the hybrid trigger 101 to rotate about pin hole 104, which will disengage sear portion 102.2 from the sear protrusion 202.3 (such that the firing pin interface surface 202.1 rotates toward the firing pin).

Figure 10C:
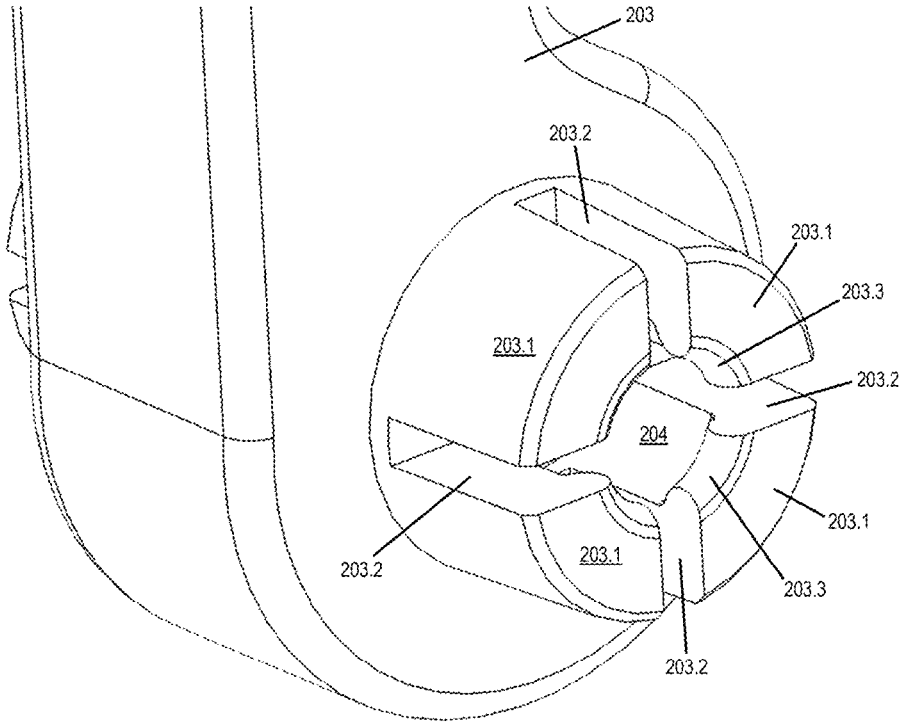
FIG. 10C is a partial detail perspective view of the hammer of FIG. 10A.
Figure 10D:
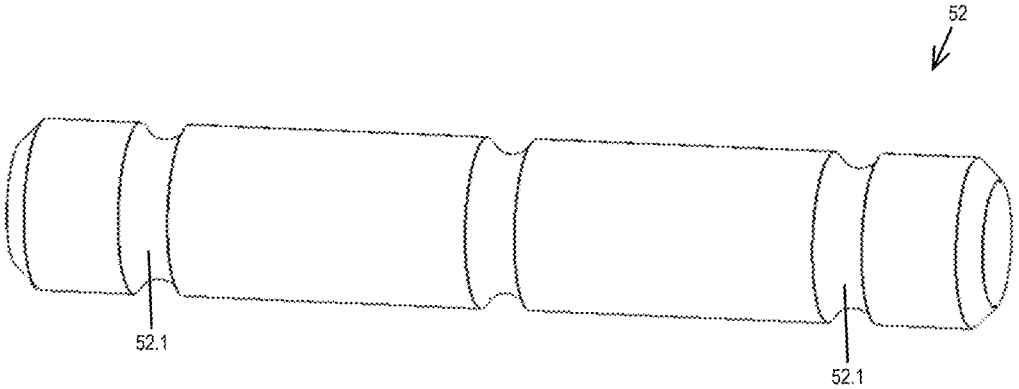
FIG. 10D is a perspective view of a hammer pivot pin of the hybrid molded assembly of FIG. 8A.

FIG. 10C shows a detailed view of the hammer molded portion 203 at the hole 204. In some embodiments, the hammer molded portion 203 includes a plurality of moveable portions 203.1 that are separated from one another by slots 203.2. FIG. 10C illustrates four moveable portions 203.1 that are separated from one another by four slots 203.2; however, the hammer molded portion 203 may include any number of moveable portions 203.1 and slots 203.2. In addition, the moveable portions 203.1 may include a protrusion 203.3. In some embodiments, each protrusion 203.3 extends in a radial direction toward a center of the hole 204. When the pivot pin 52 is inserted into the hole 204, the protrusions 203.3 (which contact the surface of the pivot pin 52) cause the moveable portions 203.1 to deflect away from hole 204 (not shown). In addition, to fully engage the pivot pin 52, the protrusions 203.3 engage the notch 52.1 of the pivot pin 52 (see FIG. 10D) to prevent movement of the pivot pin 52 in the axial direction relative to the hybrid hammer 201. Although FIGS. 10A-10C focus on the left side of the hammer molded portion 203, protrusions 203.3 on one or both sides of the hammer molded portion 203. As shown in FIG. 10D, the pivot pin 52 may include notches 52.1 at each end.

Figure 6A:
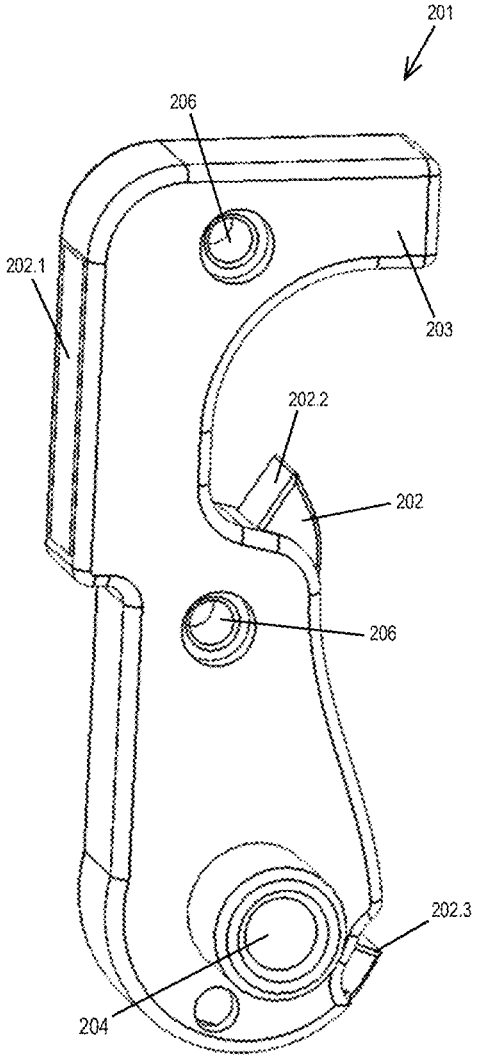
FIG. 6A is a perspective view of a hammer of the hybrid molded assembly of FIG. 1A.
Figure 6B:
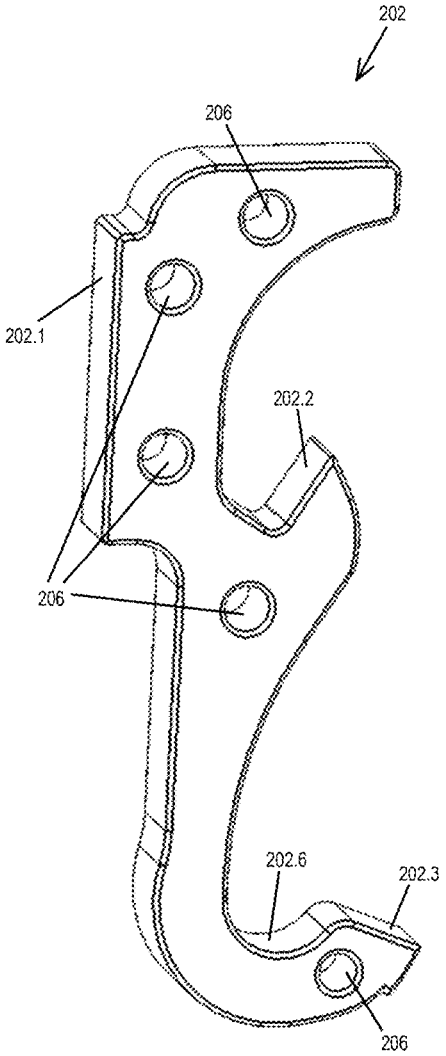
FIG. 6B is a perspective view of a hammer skeleton of the hybrid molded assembly of FIG. 1A.

The hammer skeleton 202 may include at least one assembly hole 206 (see FIGS. 6A, 6B, and 10B). The at least one assembly hole 206 may be used to secure the hammer skeleton 202 during a molding process where the material for the molded portion 203 is added or injected (and subsequently cured).

Figure 7A:
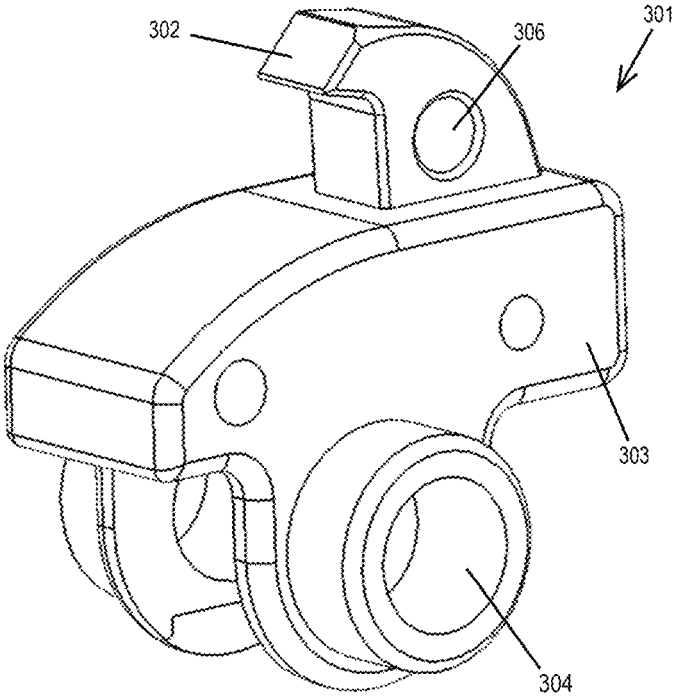
FIG. 7A is a perspective view of a disconnector of the hybrid molded assembly of FIG. 1A.
Figure 7B:
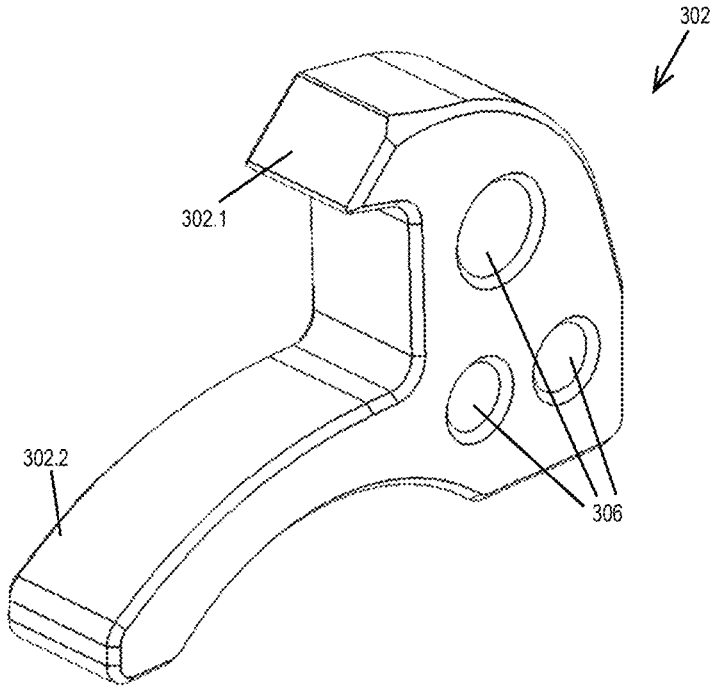
FIG. 7B is a perspective view of a disconnector skeleton of the hybrid molded assembly of FIG. 1A.
Figure 8A:
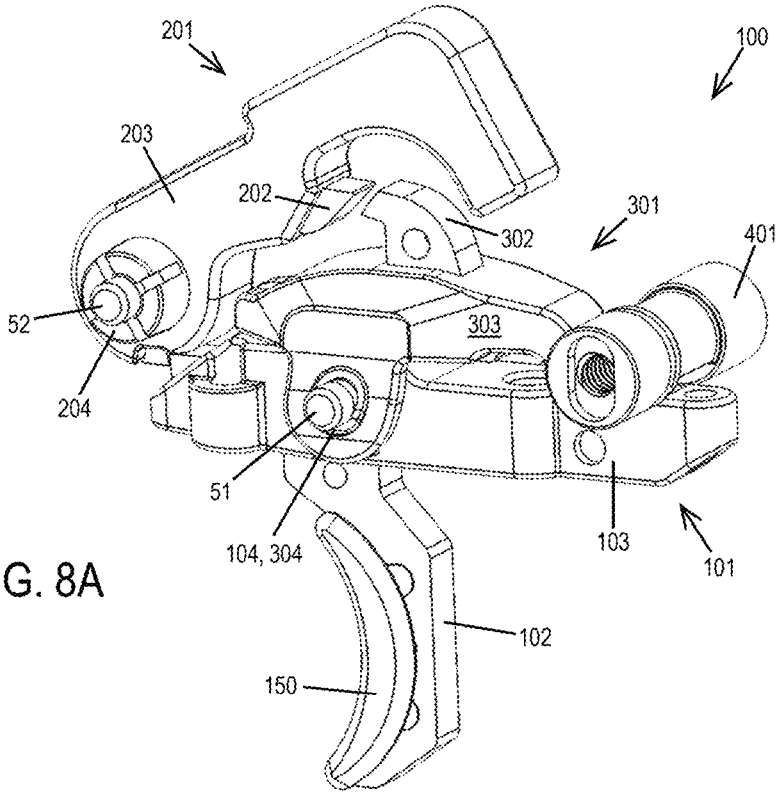
FIG. 8A is a rear perspective view of a hybrid molded assembly for a firearm, according to certain embodiments of the present invention.
Figure 8B:
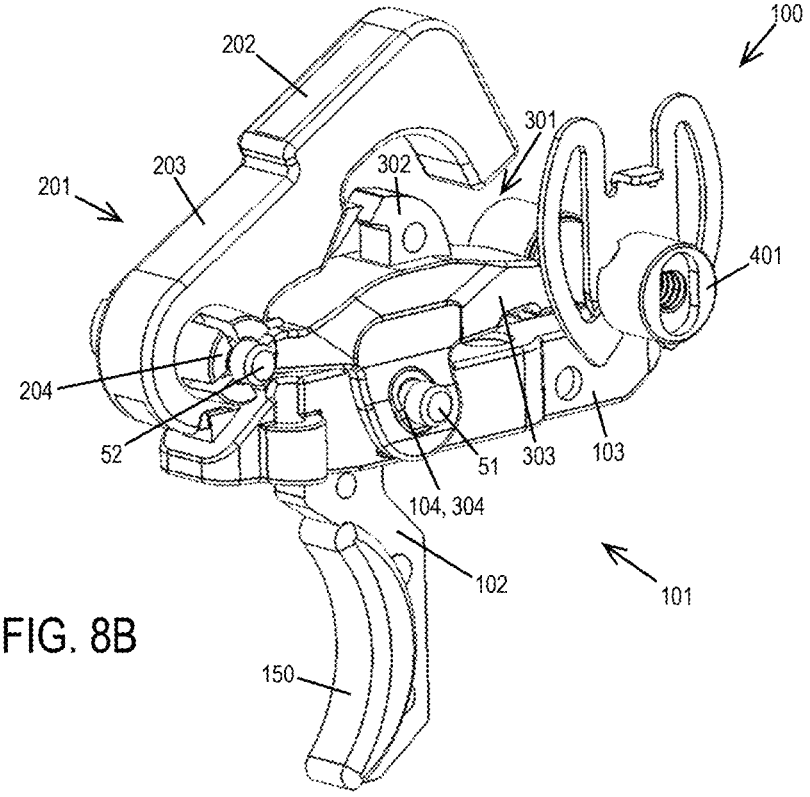
FIG. 8B is a rear perspective view of the hybrid molded assembly of FIG. 8A.
Figure 11A:
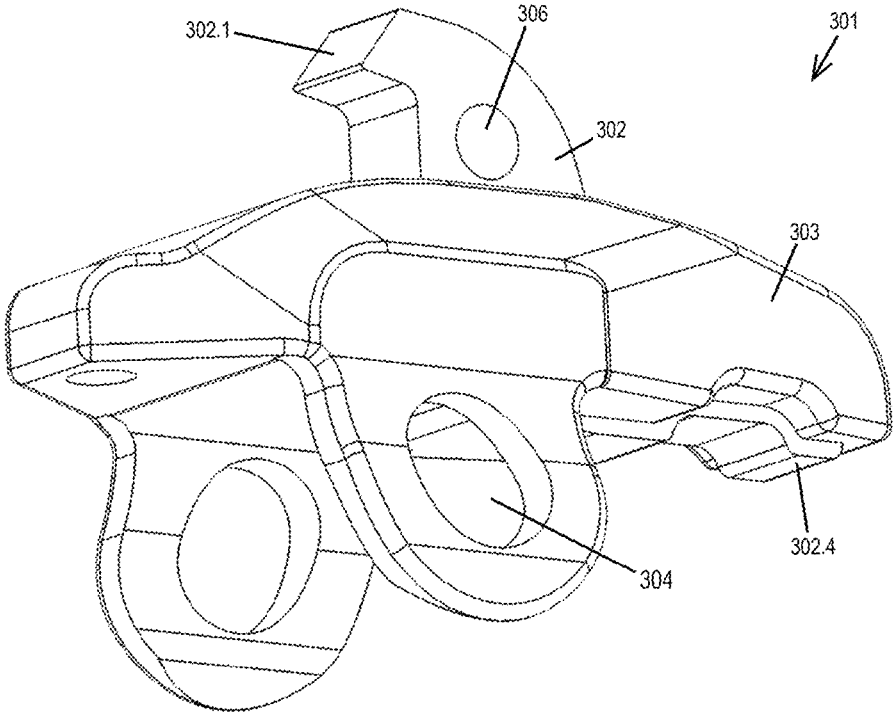
FIG. 11A is a perspective view of a disconnector of the hybrid molded assembly of FIG. 8A.
Figure 11B:
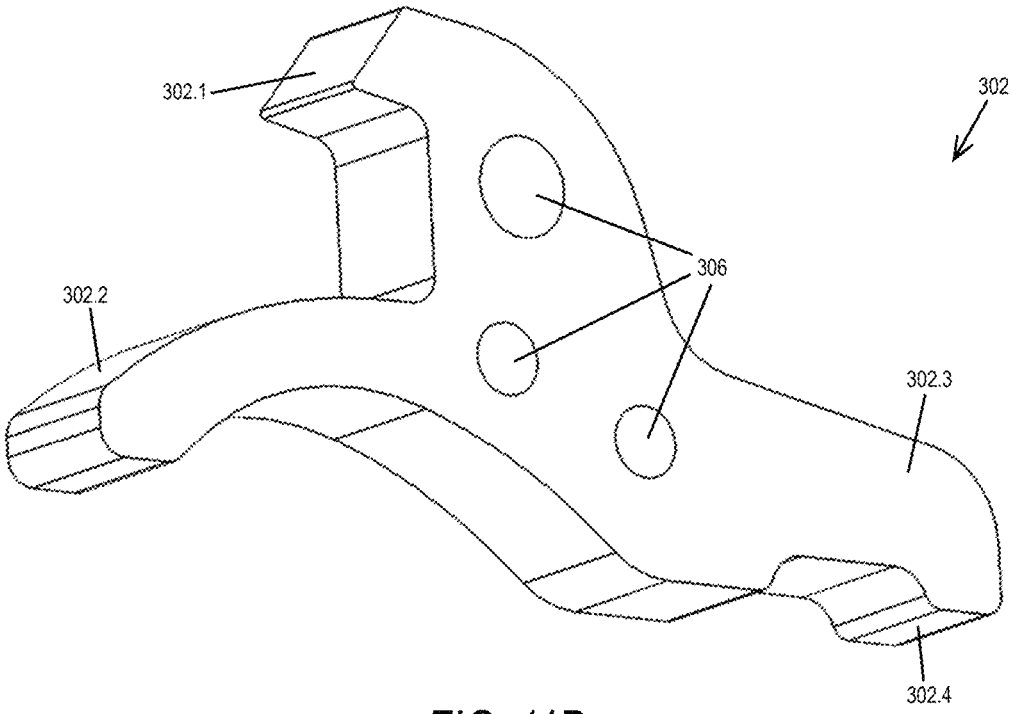
FIG. 11B is a perspective view of a disconnector skeleton of the hybrid molded assembly of FIG. 8A.

The hybrid disconnector 301 is shown in FIGS. 7A, 11A and includes a disconnector molded portion 303. As shown in FIGS. 7A, 7B, 11A, and 11B, the hybrid disconnector 301 also includes a disconnector skeleton 302. The disconnector skeleton 302 of the hybrid disconnector 301 includes at least one of a forward portion 302.2 and a rear portion 302.3. The disconnector skeleton 302 may also include at least one disconnector exposed portion that is at least partially exposed at the surface of the disconnector molded portion 303 (and/or at least partially extends beyond the disconnector molded portion 303). The disconnector exposed portion may include at least one of a disconnector hook 302.1 and a spring portion 302.4. For example, the disconnector hook 302.1 extends beyond the surface of disconnector molded portion 303 (see FIGS. 7A and 11A). In some embodiments, the rear portion 302.3 of the disconnector skeleton 302 includes a spring portion 302.4 that is at least partially exposed at the surface of the disconnector molded portion 303 (and/or at least partially extends beyond the disconnector molded portion 303). The spring portion 302.4 may interface with the disconnector spring (which is retained in disconnector spring cavity 103.1). The hybrid disconnector 301 rotates about pin hole 304. As shown in FIGS. 7A, 7B, 11A, and 11B, the disconnector skeleton 302 may include at least one assembly hole 306. The at least one assembly hole 306 may be used to secure the disconnector skeleton 302 during a molding process where the material for the molded portion 303 is added or injected (and subsequently cured).

The components of the hybrid molded assembly 100 may be formed of materials including, but not limited to, steel, aluminum, stainless steel, high strength aluminum alloy, carbon composite, plastic, thermoplastic, nylon, other plastic or polymer materials, other metallic materials, other composite materials, or other similar materials. In particular, the trigger skeleton 102, the hammer skeleton 202, and disconnector skeleton 302 may be steel parts and, in some embodiments, may be stamped steel parts that require minimal machining. The trigger molded portion 103, the hammer molded portion 203, and the disconnector molded portion 303 may be plastic or thermoplastic and, in some embodiments, may be formed using material injected into a mold and subsequently cured. Moreover, the components of the hybrid molded assembly 100 may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A hybrid hammer assembly for a firearm, the hybrid hammer assembly comprising:

a pin hole;

a hammer rotatable about the pin hole, the hammer comprising:

a metallic hammer skeleton comprising a firing pin interface surface; and a hammer molded portion that at least partially encompasses the metallic hammer skeleton, wherein the metallic hammer skeleton comprises:

a first portion disposed adjacent to and at least partially surrounding the pin hole; and a second portion extending from the pin hole towards and beyond the firing pin interface surface.

2. The hybrid hammer assembly of claim 1, wherein at least a portion of the firing pin interface surface protrudes through the hammer molded portion.

3. The hybrid hammer assembly of claim 1, wherein the metallic hammer skeleton comprises a sear protrusion that engages a trigger, wherein the sear protrusion is disposed adjacent to the pin hole.

4. The hybrid hammer assembly of claim 3, wherein at least a portion of the sear protrusion protrudes through the hammer molded portion.

5. The hybrid hammer assembly of claim 1, wherein the metallic hammer skeleton comprises a disconnector interface tooth that engages a disconnector, wherein the disconnector interface tooth is disposed on a rear side of the hammer that is opposite of the firing pin interface surface.

6. The hybrid hammer assembly of claim 5, wherein at least a portion of the disconnector interface tooth protrudes through the hammer molded portion.

7. The hybrid hammer assembly of claim 1, wherein the metallic hammer skeleton comprises a plurality of assembly holes, wherein a portion of the hammer molded portion fills at least some of the plurality of assembly holes to aid in mechanical attachment between the metallic hammer skeleton and the hammer molded portion.

8. The hybrid hammer assembly of claim 1, wherein the hammer molded portion comprises a polymer material.

9. The hybrid hammer assembly of claim 1, wherein the metallic hammer skeleton comprises a steel material.

10. The hybrid hammer assembly of claim 1, wherein the firing pin interface surface is one of at least two parts of the metallic hammer skeleton that protrude to be at least flush with an outer surface of the hammer molded portion.

11. The hybrid hammer assembly of claim 1, wherein the metallic hammer skeleton comprises a hole that is concentric with the pin hole.

12. A hybrid hammer assembly for a firearm, the hybrid hammer assembly comprising:

a pin hole;

a hammer rotatable about the pin hole, the hammer comprising:

a metallic hammer skeleton comprising a firing pin interface surface; and a hammer molded portion that at least partially encompasses the metallic hammer skeleton; and a plurality of movable portions adjacent to the pin hole, wherein each of the movable portions are movable in a radial direction relative to the pin hole.

13. The hybrid hammer assembly of claim 12, wherein the plurality of movable portions are separated from one another by slots.

14. The hybrid hammer assembly of claim 12, wherein each of the movable portions comprise a protrusion that extends in the radial direction toward a center of the pin hole.

15. The hybrid hammer assembly of claim 14, wherein the protrusions engage at least one notch in a pivot pin that is inserted into the pin hole.

16. The hybrid hammer assembly of claim 12, wherein the plurality of movable portions are integral components of the hammer molded portion.

17. The hybrid hammer assembly of claim 12, wherein the hammer molded portion comprises an injection-molded material.

18. The hybrid hammer assembly of claim 12, wherein the hammer molded portion comprises a polymer material.

19. The hybrid hammer assembly of claim 12, wherein the metallic hammer skeleton comprises a hole that is concentric with the pin hole.

20. The hybrid hammer assembly of claim 12, wherein the firing pin interface surface is one of at least two parts of the metallic hammer skeleton that protrude to be at least flush with an outer surface of the hammer molded portion.

* * * * *